United States Patent [19]

McWillis

[11] Patent Number: 4,796,504

[45] Date of Patent: Jan. 10, 1989

[54] MUSICAL INSTRUMENT

[76] Inventor: Harlan McWillis, 5529 Duarte St., Los Angeles, Calif. 90058

[21] Appl. No.: 891,924

[22] Filed: Jul. 30, 1986

[51] Int. Cl.[4] ..... G10D 1/04

[52] U.S. Cl. ..... 84/265; 84/291

[58] Field of Search ..... 84/184, 187, 192–196, 84/264–266, 290, 191

[56] References Cited

U.S. PATENT DOCUMENTS

| | | | |
|---|---|---|---|
| 1,501,907 | 7/1924 | Kirk | 84/264 |
| 1,702,643 | 2/1929 | Claiborne | 84/264 |
| 3,051,033 | 8/1962 | Pratt | 84/265 |
| 3,312,136 | 4/1967 | Graves | 84/192 |

*Primary Examiner*—Benjamin R. Fuller

*Attorney, Agent, or Firm*—Nilsson, Robbins, Dalgarn, Berliner, Carson & Wurst

[57] ABSTRACT

A musical instrument having a body comprising a case and a sound board closing one side of the case and strings stretched on the instruments so as to impart a force on the soundboard, in which the edges of the soundboard are movable relative to the adjacent edges of the case. A ridge is provided on the underside of the soundboard, along its edges, which serves to impart rigidity to the soundboard and is also formed to reflect sound vibrations. The instrument is preferably of the harp type having a neck connected at one end to the upper end of the body, the strings being connected to and stretched between the neck and the soundboard. A post extending from the neck is secured to the soundboard by means of a horizontal strut secured to and extending normal to the bottom end of the post.

20 Claims, 4 Drawing Sheets

FIG. 2
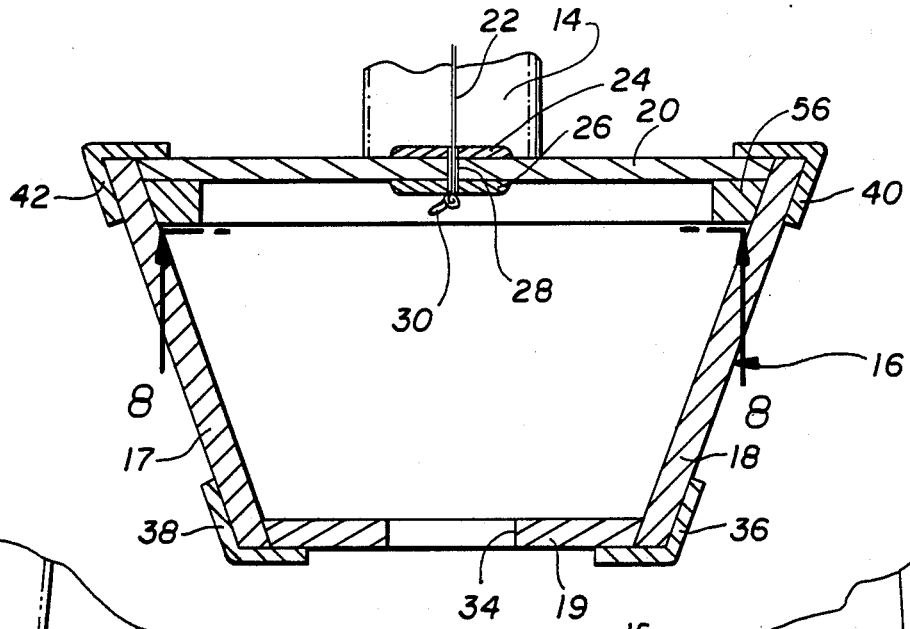
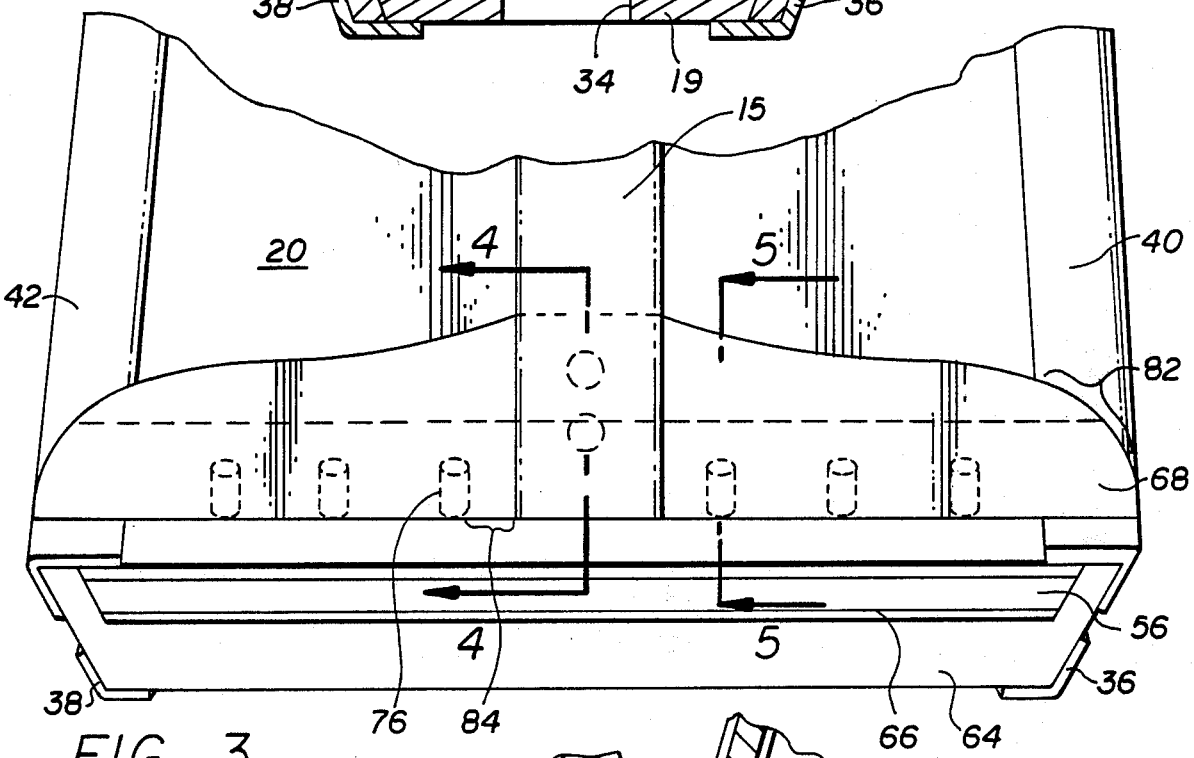
FIG. 3
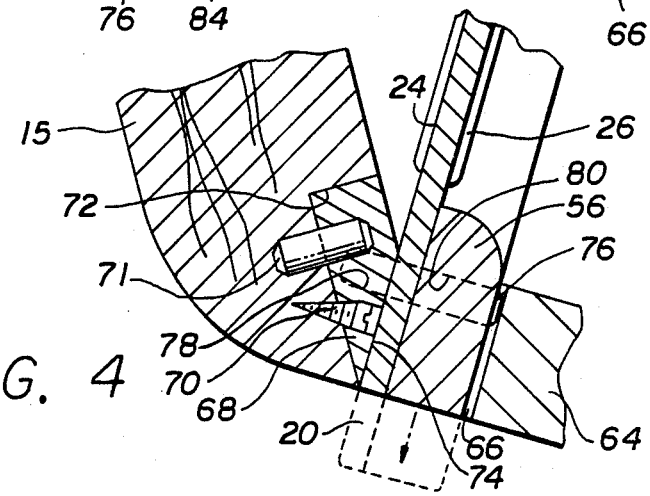
FIG. 4

FIG. 8
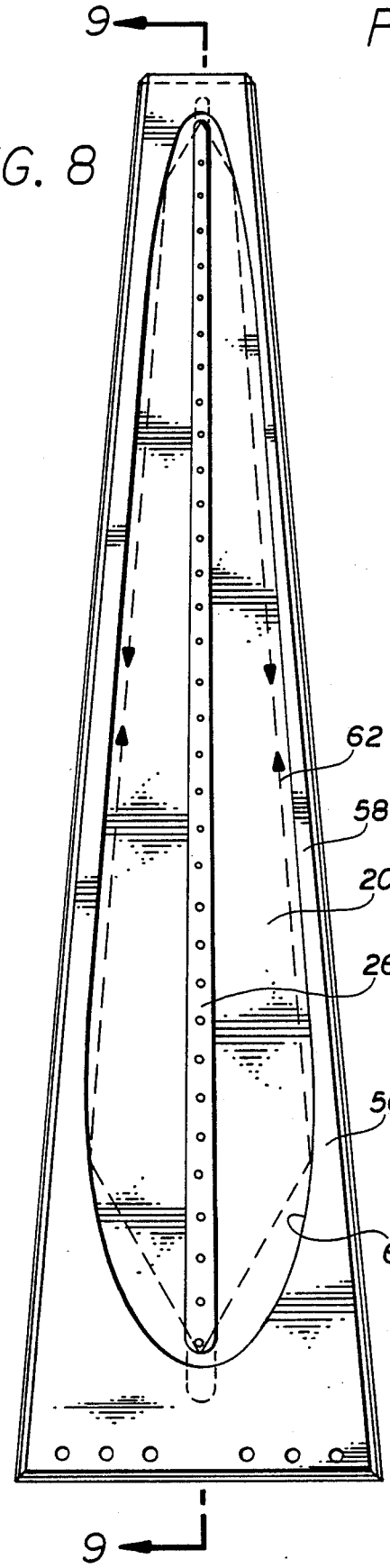
FIG. 9
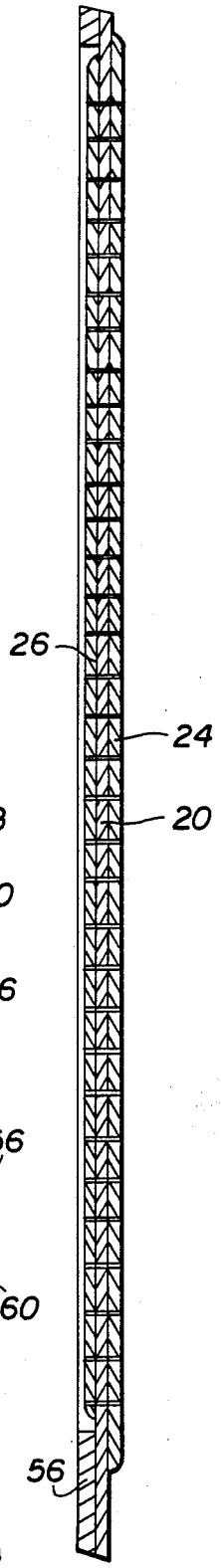
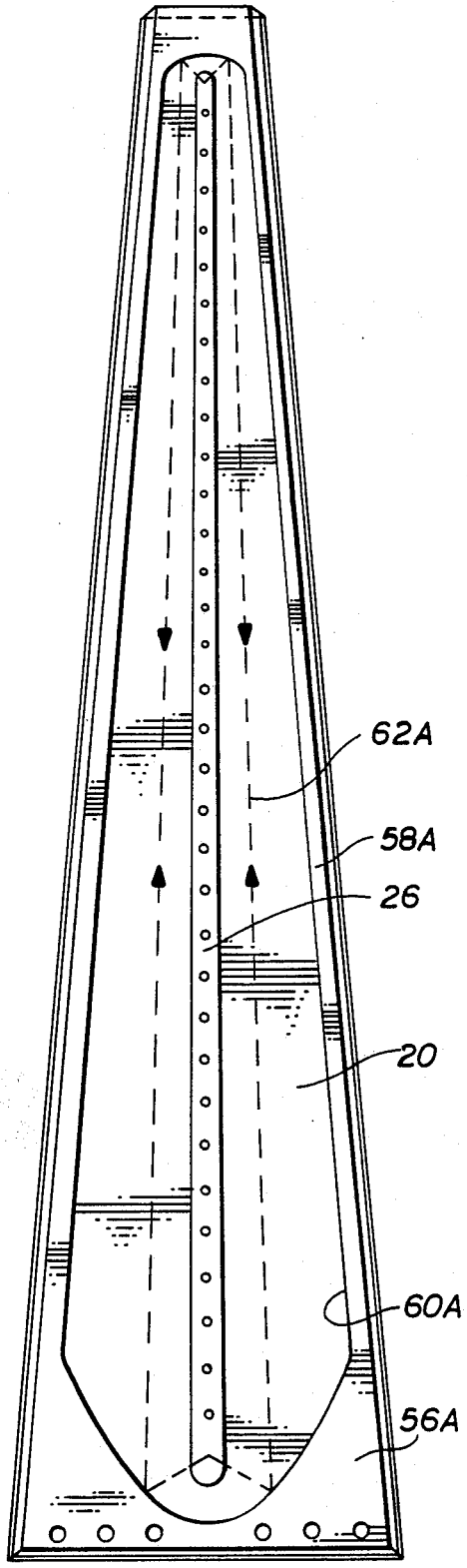
FIG. 10

MUSICAL INSTRUMENT

FIELD OF THE INVENTION

The field of art to which the invention pertains is the field of musical instruments, in particular musical instruments of the harp type.

BACKGROUND AND SUMMARY OF THE INVENTION

A harp is a musical instrument with strings that are varied in a graduated manner both in length and in thickness. Typically a harp has a body, a neck (also called an "arch") having an end connected to the upper end of the body, and a post at the other end of the neck extending to the lower end of the body. The body comprises an elongate case and an elongate soundboard (also called a "table"). The harp strings are stretched between the neck and the soundboard and are secured to a strip that is fixed centrally and axially on one or both sides of the soundboard. The pull of the strings is resisted on the bass end by the post (also called a "pillar") and on the treble end by the neck. The neck or arch is also called the harmonic curve and is the result of an effort to employ lengths that are correlated to the thicknesses of the strings so as to yield a pleasant tone when the strings are plucked. The sinusoidal quality of the harmonic curve also contributes to the graceful quality of the harp's appearance.

Harps vary in size from the large concert or classical harp to the small folk harps such as the Celtic harp, Minstrel harp, and Paraguayan harp, but all of which have essentially the components referred to above. The smaller harps are not simply miniature versions of the larger harps, but suffer certain defects in tonality and response due in substantial measure to the relative shortness of the soundboard and case; larger harps have a greater tolerance for various structures used to secure the components of the harp. The present invention is directed to a number of improvements to the harp structure which have particular applicability to small harps such as the folk harp, but which nevertheless can also be put to good use on the larger, concert or classic harps as well as on other instruments that use a soundboard that is subject to the forces of tensioned strings. In this regard, the concepts of this application have broad application to all such instruments such as lyres, guitars and similarly fretted instruments, violins, violas, cellos, bases and even pianos and harpsichords.

One embodiment of the invention is directed to an improvement in the relationship of the soundboard to the case. Traditionally, the soundboard or table is made from Sitka Spruce and is glued and screwed to a sound case (also called a soundbox) which is in the form of a trapezoidally-shaped trough or a trough which is a semicircle in cross-section. In either example, the radius of the semi-circle or diagonal of the trapezoid is much greater at the bass end of the soundboard than at the treble end. The underside of the case is formed with openings which allow access to the strings, so that knots can be tied to secure the strings, and also help to vary the resonance characteristics of the sound case so that its response to the frequencies of the strings covers a broad spectrum of sound.

To assist in the resonance response, the sound case is usually made of thin materials, such as several thicknesses of veneer stock glued and cross-laminated to give it strength in two dimensions. To resist the deforming action of the pull of the strings on the soundboard, bracing is typically placed inside at regular intervals. This bracing can be of wood, but is often made from metal castings. The pull of the strings imparts an upward curve to the soundboard which, because the soundboard is rigidly connected to the case, translates into a force that brings the edges of the sound case closer together. The bracing is needed to resist this pull, but the addition of metal bracing has a deleterious effect on the tone of the harp, imparting definite irrational overtones affecting the quality of the harp's tone or voice. The bracing also adds to the weight of the harp.

Besides the effect of bracing, the gluing and screwing of the soundboard to the sound case also has a restrictive influence on the modes in which the soundboard can vibrate. The vibration of the strings forces a vibration of the soundboard through the principle of forced resonance. Any natural resonances which the board has which coincide with the fundamental or overtone frequencies of the strings will thus be strengthened by the board. When the board is attached in the traditional manner, it acts like a clamped membrane, resulting in a built-in hysteresis generating a poor response to longer sound wavelengths and an increase in higher overtones. Thus, the voice of small harps tends to be high and to lack the mellow quality found in large concert harps, in which the soundboard is long enough to compensate for the clamping effect. In addition to the foregoing drawbacks, if the soundboard of a harp becomes damaged, its removal is a major undertaking requiring the services of a trained harp repairman.

In accordance with the first embodiment, an improvement is made to soundboards by movably securing the soundboard to the case. More specifically, the soundboard is secured such that at least a first side edge of the soundboard is movable relative to the adjacent side edge of the case when the soundboard is pulled by the strings. In a practical aspect of this embodiment, retaining rails are placed on both sides of the sound case to hold the soundboard in place. A simple molding is secured to the outer edge of the sound case, for example a wooden molding is glued thereto, and the soundboard is prevented from being pulled away from the sound case by the presence of these rails. At the treble end of the sound case, a wooden cap is glued in place which resists the upward thrust of the soundboard at that end. Importantly, because the soundboard is free to move against the surface of the retaining rails, no deforming forces are exerted against the sides of the sound case and the need for internal bracing is thereby eliminated. Also, because the soundboard is not rigidly attached to the sound case, the entire surface of the board is less restricted in its vibrational mode and it is able to respond to a wider spectrum of musical sound. The result is a sound which is both louder and mellower. Because the board is not glued and screwed to the sound case, if there is any injury to the board it is a simple matter to disassemble the harp and replace the soundboard. The damaged board can be pulled out and a new one pushed in.

In a second embodiment, a mechanism is provided for substantially enhancing the resonance of the soundboard. Part of the tonal quality of a harp depends on the principle of sympathetic resonance, in which the entire set of properly tuned strings forms a sympathetic resonance system. When any one string is plucked, it produces its fundamental tone as well as a series of overtones or harmonics. These harmonics will correspond to the fundamentals and overtones of other strings in the system. For example, the first overtone of a low "G" will correspond to the "G" an octave higher and its second overtone will correspond to the "D" above that "G". At the same time, the third overtone of the low "G" will correspond to the first overtone of the "G" an octave above it. Thus, when the low "G" is plucked, its overtones are reinforced by other strings through the sympathetic resonance system. The soundboard is the medium through which this is accomplished.

In normal harp construction, many of the sound waves remain concentrated in the soundboard, but many others travel through other parts of the harp where their ability to excite sympathetic resonance is lost and where they are not able to properly excite the air molecules. This partly results from the hysteresis referred to above, due to the rigid clamping of the soundboard. The shape of the board itself also tends to distribute the sound in a dissipating pattern.

When a vibrating membrane meets a barrier which is stiffer, denser or thicker, in which the speed of sound is greater, some of the energy of the vibration passes through the barrier and some of the energy is reflected. Thus, a soundboard when it meets the sound case in the usual harp construction reflects back some of the vibration energy into the board. However, the direction of that reflection varies in such a way that it dissipates the sound. In accordance with the second embodiment, an improvement in the sympathetic resonance system is achieved by reflecting the sound vibrations and concentrating them in a focused manner. More particularly, a structure is provided in the form of ridges along the edges of the soundboard, constructionally a "focus board" glued to the underside of the soundboard, which serves to reflect sound vibrations. This focus board defining the ridges around the soundboard is cut into a curve such that vibrations coming from one specific point will be reflected to, and concentrated at, a second point remote to the first point. In this manner, the sound waves are returned to the middle of the board where they can best activate the sympathetic resonance system.

In a further aspect of this embodiment, the focus board or ridges act in conjunction with a string strip. Harps are normally designed with a center string strip. This is secured centrally and axially to the soundboard, running from the bass end to the treble end. It is a narrow, rather thin board made of hardwood and typically consists of two pieces: one, which is thinner, is glued to the top of the soundboard; the other, which is thicker, is glued to the underside of the soundboard. The center strip and soundboard thereby define a three layer sandwich with the soundboard being the middle layer. Holes are drilled through this strip-soundboard-strip-sandwich throughout its entire length. The ends of the harp strings are threaded through the holes and secured by knots to the underside so that when they are stretched by the tuning pegs, they will pull against the board. Because of the thickness of the centerstrip sandwich, sound waves pass quickly up and down the soundboard and this helps greatly in the activation of the sympathetic resonance system.

In a preferred aspect of the second embodiment, the arrangement of the ridges defining the focus board is such that the points of focus are preferably at the points where the centerstrip ends. This is a point from which the sound waves can radiate out to the focus board barrier so that they can be reflected to be refocused onto the other end of the soundstrip. Examples of curves that can be used are ellipses and parabolas. In using a parabola for creating a focus board, the adjacent end of the centerstrip is disposed to lie at the focus point of the parabola. The ridges defining the focus board are advantageously formed of a material which is thicker and/or denser than the material of the soundboard, aiding in the reflection of the sound vibrations.

A further advantage of using the focus board is that it strengthens and reinforces the soundboard. The pull of the strings acting on the string strip in the center axis of the soundboard tends to pull the edges of the board inwardly, but which pull is resisted by the focus board. Thus, this embodiment synergistically combines with the first embodiment.

In a still further aspect of this embodiment, by placing the lowest bass string at the lowermost focal point of the focus board, an augmentation of the bass results. Wave forms from any string higher than this point are focused in the area between the end of the string strip and the lowest string. Therefore, the focus board catches the sound waves and returns them to the sympathetic resonance system, resulting in a harp having an excellent response to long sound waves, i.e., the bass tones.

A third embodiment of the invention is directed to eliminating the deleterious effect of the pillar or post securement on the bass tones of the harp. Traditional harp construction places the end of the pillar or post at the bottom of the soundboard where it contacts the end of the string strip. To keep everything in alignment, a large wood screw or bolt passes through the post, soundboard and soundcase. Variations in design have eliminated this wood screw or the use of a bolt at this point, but as a general matter, the resistance to the tension of the strings on the board remains concentrated in one small area at the end of the board and bottom of the soundcase. This area is referred to as the "yoke" and is one of the most troublesome parts of a harp. The tremendous accumulation of tension at this point exerts a shearing effect on the wooden parts of the harp and can cause harps to self destruct.

Besides creating a point of design weakness, the position of the post is very close to that of the lowest harp strings so that the clamped membrane effect on the soundboard is most pronounced on the bass tones. Indeed, on most large harps, the very lowest strings have such poor quality that they are rarely used. In effect, the action of the board on the lowest strings is so stiff that it can only give about a quarter of the response that a free vibrational mode would allow.

In accordance with the third embodiment, this weakness in the design of the yoke is eliminated, allowing more vibrational freedom to the board. In particular, the tension of the post is distributed across the entire lower surface of the soundboard and the sound case by means of a horizontal strut secured to and extending normal to the bottom end of the post on each side of the post and secured to the front side of the soundboard. The soundboard is formed with peg holes along its bottom end and the horizontal strut has pegs at corresponding locations sized to fit the holes, thereby securing the strut to the soundboard. The pegs are spaced from the post to allow as much freedom as possible to the soundboard. The result is a more resonant responsive board.

As a result of the foregoing three embodiments, a lightweight, inexpensive, sonorous, resonant, strong and easily-repaired harp is provided.

BRIEF DESCRIPTION OF THE DRAWINGS

FIG. 2 is a cross-sectional view of the body of the harp taken on line 2—2 of FIG. 1;

FIG. 3 is an elevational view of line 3—3 of FIG. 1 of the lower portion of the harp;

FIG. 4 is a cross-sectional view taken on line 4—4 of FIG. 3 showing the connection of the harp post and horizontal strut to the sound/focus board, and showing, in shadow, removal of the sound/focus board;

FIG. 8 is a plan view of the underside of the soundboard and one form of the focus board, taken on line 8—8 of FIG. 2, also showing a central string strip;

FIG. 9 is a cross-sectional view of the sound/focus board of FIG. 9, taken on line 9—9 of FIG. 8; and FIG. 10 is a plan view of the underside of the soundboard, similar to FIG. 8 but showing another form of focus board.

DETAILED DESCRIPTION

Figure 1:
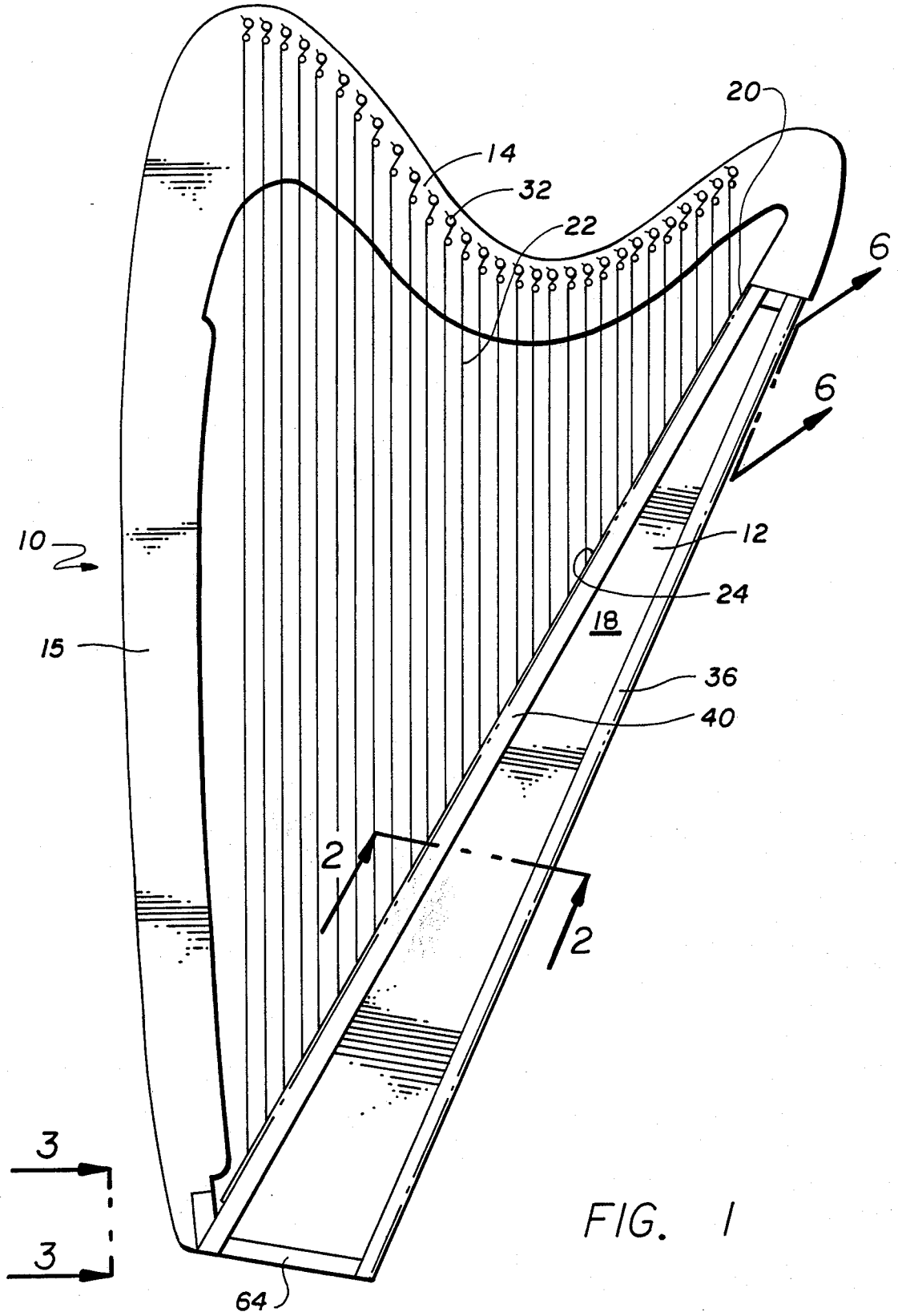
FIG. 1 is an elevational view of a harp constructed in accordance with the present invention.

Referring to FIGS. 1 and 2, there is shown a harp 10 formed as usual with a body 12, neck, or arch 14, and post 15. The body is formed of a case 16 and associated soundboard 20. The case 16 has sidewalls 17 and 18 and a rear wall 19. As usual, strings, such as 22, are stretched between the neck 14 and the soundboard 20. Front and rear string strips 24 and 26, respectively, are secured centrally along the longitudinal axis of the soundboard 20 running from the base end to the treble end of the soundboard. The string strips 24 and 26 are narrow, thin board made of hardwood. The front strip 24 is thinner than the rear strip 26 and is glued to the front or top of the soundboard 20 while the rear, thicker strip is glued to the underside or rear of the soundboard 20, forming a three-layer sandwich with the soundboard 20 being the middle layer. Holes, such as at 28, are drilled through this sandwich along the length of the soundboard corresponding to the number of strings 22. The ends of the harp strings are knotted as at 30 on the underside of the soundboard so that when they are stretched by tuning pegs 32 on the neck of the harp 10, they will pull against the soundboard 20. Because of the thickness of the centerstrip sandwich, sound waves pass quickly up and down the soundboard 20, helping to activate the sympathetic resonance system.

The sound case or sound box 16 in this embodiment is a trapezoidally shaped trough, the rear wall 19 of which is formed with openings, one of which is shown at 34, distributed longitudinally centrally of the rear wall 19 in the usual manner. The openings allow access to the strings 22 so that the knots 30 can be tied and also contribute significantly to the resonance characteristics of the sound case 16. The sound case 16 can be made of several thicknesses of veneer stock glued and cross-laminated. Reinforcement rails 36 and 38, such as wooden molding, are glued to the lower corners of the sound case 16 and extend along its length to strengthen its construction.

Similar rails 40 and 42 are secured by glue along the top edges of the sound case, but for a significantly distinct purpose, to serve as retaining rails for the soundboard 20. In this regard, the soundboard 20 is not fixed to the sound case 16, i.e., it is not glued, nailed or bolted or otherwise rigidly secured to the soundboard 16. Rather, it is held in place by the retaining rails 40 and 42, and to some extent at its top end, as will be described below. The rails 40 and 42 overlap the outer edges of the soundboard 20 to retain it against the case 16. As shown in shadow in FIG. 4, the soundboard 20 (along with a focus board to be described hereinafter) can be pulled out, away from the sound case 16, if it is necessary to repair or replace it. The soundboard is free to move against the confronting surface of the retaining rails 40 and 42 thereby eliminating deforming forces that otherwise would be exerted against the sides of the sound case 16. Accordingly, there is no need to provide the sound case 16 with internal bracing, eliminating the irrational overtones that can accompany the internal use of braces.

Figure 6:
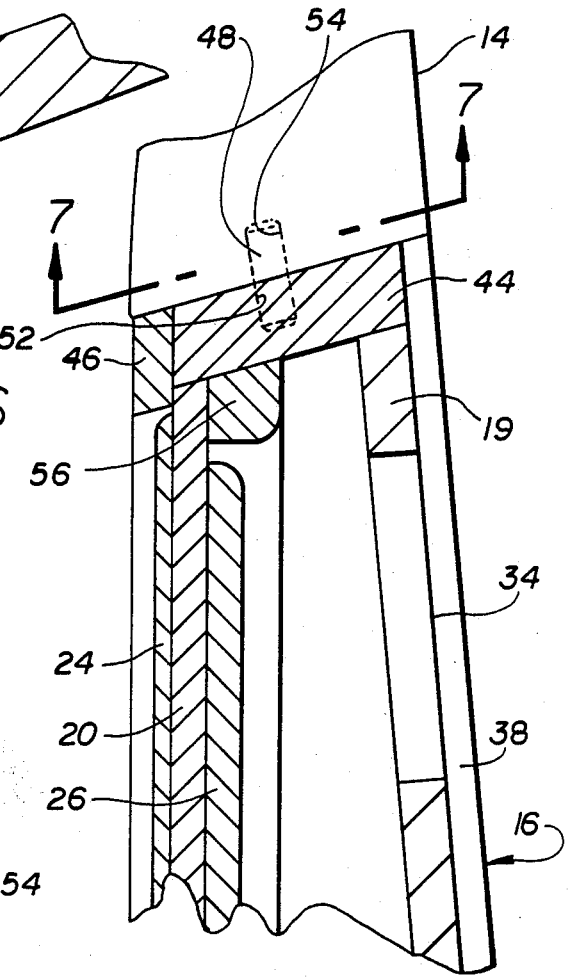
FIG. 6 is a cross-sectional view taken on line 6—6 of FIG. 1, showing the treble end of the soundcase and a wooden cap thereat.
Figure 7:
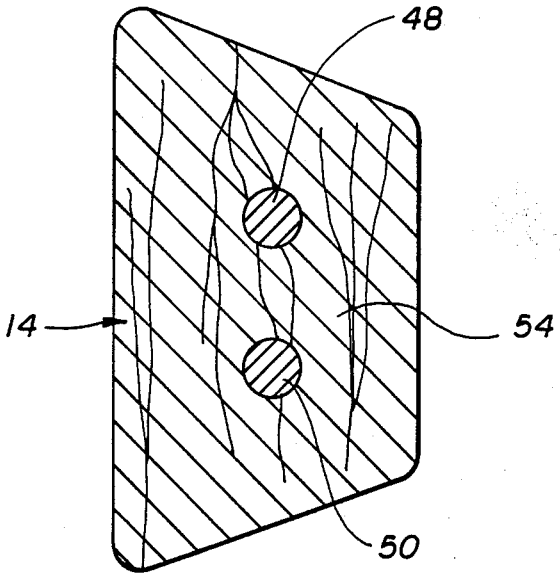
FIG. 7 is a cross-sectional view taken on line 7—7 of FIG. 6 of the neck of the harp and its dowel connectors.

FIG. 6 shows a cross-sectional view of the top end of the body 12 where it connects to the neck 14. A wooden cap 44 about one half inch thick is glued in place inside the top end of the sound case 16 and is fitted with a front piece 46 glued thereto which overlaps the soundboard 20. As shown additionally in FIG. 7, the neck 14 of the harp is secured to the cap 44 by a pair of dowels 48 and 50 that extend in corresponding dowel holes, e.g., 52 and 54, in the cap 44 and confronting surface of the neck 14, respectively.

Referring additionally to FIGS. 8 through 10, there is shown as a second embodiment of the invention a mechanism for substantially enhancing the resonance of the soundboard. This takes the form of a structure which can be called a "focus board", one form 56 of which is shown in FIGS. 8 and 9, and another form 56*a* is shown in FIG. 10. Referring first to the embodiment shown in FIGS. 8 and 9, the focus board 56 is formed elongate to match the outer contours of the soundboard 20 and is glued to the underside of the soundboard 20. It is structured with elongate ridges 58 extending into the case along the edges on the rear side of the soundboard 20. The ridges define an elongate opening 60 in the focus board 56 of predetermined geometrical shape designed to reflect sound vibrations.

The focus board 56 actually serves a dual function, in that it also strengthens and reinforces the soundboard 20. The pull of the strings 22 acting on the string strips 24 and 26 in the central axis of the soundboard 20 tends to pull the edges of the soundboard 20 inwardly. This pull is resisted by the structural rigidity of the focus board 56 which assists and makes more viable the first embodiment, namely the movability of the soundboard edges relative to the sound case 16.

The sound focusing function is illustrated in FIG. 8 by the dashed, arrowed lines 62 representing a typical sound path. The shape of the opening 60 in the focus board 56 is such that the points of focus are preferably at the end points of the rear string strip 26. This is a point at each end from which the sound waves can radiate out to the focus board barrier so that they can be reflected to be refocused onto the other end of the rear string strip 26.

In the embodiment shown in FIG. 8, the focus board curved opening 60 is in the proximate form of an ellipse. Some compromise with optimum elliptical shape has been made because the area in which the ellipse must fit is wedge shaped; too fat an ellipse exceeds the boundary of the wedge, and staying within the boundary of the wedge yields too small a soundboard surface. Thus, a rather fat ellipse is used at the bass end and a thin ellipse at the treble end. These two ellipses are connected to each other by opposed straight inner surfaces of the ridges 58.

Referring to FIG. 10, a focus board **56*a* of construction similar to that of FIG. 8 is shown but wherein the curved opening 60*a*, formed by the ridges 58*a*, is in the form of a parabola. In using a parabola, each end of the string strip 26 is disposed to lie at the focus point of a parabola. The axis of symmetry of each parabola lies on the string strip line and the sound waves are focused in nearly parallel lines to either end of the board, as indicated by the dashed arrowed line 62*a*. When the waves reach a parabola boundary, they are refocused toward the end of the string strip 26** to re-enter the sympathetic resonance system.

Although the drawings show focus boards 56 and 56A with either elliptical or parabolic curved openings, one can mix the curved shapes, having a parabola at the bottom end with an ellipse at the top end, or vice versa.

Preferably, the focus board is formed of a material that is denser and/or thicker than the material of the soundboard 20. For example, whereas Sitka Spruce, about ¼" thick, is used for the soundboard 20, the focus board is formed of ½" birch, or other hard plywood. Even harder materials can be used, such as brass or aluminum, or other metals.

Although the focus board 56 is illustrated as glued to the soundboard 20, it is within the general concept of this invention that the focus board not be glued to the soundboard; it may also be free or may instead be glued and/or screwed to the sides of the sound case 16.

Particularly with the parabolic focus board **56*a*, it is advantageous to locate the lowest bass string at the point of focus of the parabola. Wave forms from strings higher than this point thus will be focused in the area between the end of the string strip 26 and the lowest bass string so that the focus board 56*a*** can catch all the sound waves and return them to the sympathetic resonance system. This results in improved response to long sound waves such as the bass tones.

The soundboard 20 with the focus board 56 glued thereto can be treated as one piece, which can be referred to as the sound/focus board 20–56. This assembly is cut along the side edges to match the planes to the surfaces it contacts, i.e., tapering to follow the contiguous shape of the sound case 16 and undercut so that it can fit close underneath the retaining rails 40 and 42. At the top, the sound/focus board 20–56 meets the treble end block 44 which restrains it from being pulled higher up into the sound case 16. Because the neck 14 pushes against the other side of the treble end block 44, very little lateral thrust is exerted against the sound case 16. This end of the sound focus board 20–56 is cut at an angle which corresponds to that of the treble end block 44. The base end of the sound/focus board 20–56 is cut to allow it be a continuation of the plane of the bass end block 64 (FIGS. 1 and 3–5), but it does not bear against the bass end block 64; in fact, a clearance 66 of about ⅛" is provided. This allows the sound/focus board 20–56 to be slid out, as shown in shadow in FIG. 4, without removing the strings 22.

Figure 5:
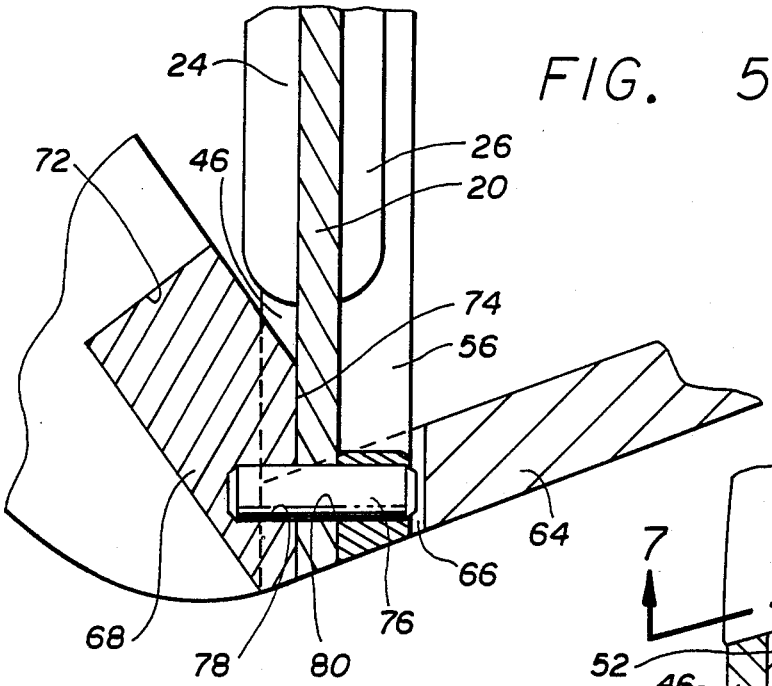
FIG. 5 is a cross-sectional view taken on line 5—5 of FIG. 3, showing the pegged connection of the horizontal strut to the sound focus board.

Referring now to FIGS. 3–5 in more detail, a structure is shown which allows the soundboard 20 substantial vibrational freedom from the yoke and of the post 15. A horizontal strut 68 is provided which serves as a means for distributing the tension across the entire lower surface of the sound/focus board 20–56 and sound case 16. The strut 68 is glued, and also secured by a screw 70 and dowel 71, at a notch 72 to the end of the post 15 so as to lie normal to the post 15. If the post 15 is considered to be vertical, then the strut 68 can be considered to be a horizontal extension on both sides of the post 15. The top part of the horizontal strut 68 is curved to harmonize with the overall lines of the harp. The bottom side 74 of the strut 68 is cut to an angle to coincide with the face of the soundboard 20. Strut pegs 76 are glued into corresponding strut holes 78 in this slanted surface 74. The strut pegs 76 pass through corresponding and complementary holes 80 in the sound-/focus board 20–56. At the ends of the horizontal strut, such as indicated by the general area 82 in FIG. 3, where the strut overlaps the retaining rails 40 and 42, notches are cut to the same depth as the thickness of the retaining rails 40 and 42. Accordingly, the pull of the strings 22 is distributed between the sound/focus board 20–56 and the sound case 16. As shown more particularly in FIG. 3, the strut pegs 76 are spaced from the post 15, as indicated at 84 to allow freedom to the soundboard 20.

Use of the strut results not only in a more resonant, responsive soundboard 20, but it avoids the tension accumulation that occurs at the usual point of contact of the post or yoke with the soundboard and case.

There has been described several embodiments pertinent to a musical instrument, particularly of the harp type, but several of the concepts have applicability to other instruments, as previously indicated. The several embodiments all coact in a synergistic way to provide a musical instrument of improved tone and volume, as well as improved structural integrity. While the foregoing description has been made with respect to the specific illustrated embodiments, the invention is not to be limited thereto, but is as broad as the appended claims and their equivalents permit.

I claim:

1. In a musical instrument having a body comprising a case having a rear side and connecting side walls having a plurality of edges defining an open front side, and a soundboard having front and rear sides provided with edges adjacent the edges of the side wall of said case closing the front side of said case, and strings stretched on said instrument so as to impart an outward force on said soundboard relative to said case, said soundboard having a front surface from which said strings extend and a rear surface facing the rear side of said case, the improvement comprising means for securing said soundboard to said case whereby all edges of said soundboard are movable by the force of said strings relative to said case.

2. The improvement of claim 1 in which said securing means comprises a rail secured along the edges of the side walls of said case and overlapping the adjacent edges of said soundboard.

3. The improvement of claim 1 in which said soundboard is disposed between the edges of the walls of said case.

4. The improvement of claim 3 in which said instrument is of a harp type having a neck at an upper end, said strings being connected to and stretched between said neck and said soundboard, and including blocking means secured to said case proximal to said neck preventing upward movement of said soundboard.

5. The improvement of claim 4 in which said blocking means comprises a wall closing an upper end of said case.

6. The improvement of claim 1 including means along edges of said soundboard on the rear side thereof for imparting rigidity to said soundboard.

7. The improvement of claim 1 including a ridge disposed along edges of said soundboard on the rear side thereof extending into said case and formed so as to reflect sound vibrations.

8. The improvement of claim 1 in which said instrument is of a harp type having a neck connected at one end to an upper end of said body and having a post at another end of said neck extending to a lower end of said body, said strings being connected to and stretched between said neck and said soundboard, said improvement further comprising a horizontal strut secured to and extending normal to said post on each side of said post and secured to the front surface of said soundboard and to said case.

9. In a musical instrument having a body comprising a case and a soundboard having a plurality of edges closing one and strings stretched on said instrument and attached to said soundboard so as to impart a force on said soundboard, the improvement comprising a ridge along the edges of said soundboard on a side facing said case extending into said case and formed so as to reflect sound vibrations, said ridge being formed with curves at opposite ends of said soundboard to concentrate said reflected vibrations at positions intermediate said opposite ends.

10. The improvement of claim 9 in which said ridge is formed of a material that is thicker and/or denser than a material of said soundboard.

11. The improvement of claim 9 in which said instrument is of a harp type having a neck at one end, said strings being connected to and stretched between said neck and said soundboard, and including a string strip having opposite ends and secured centrally and axially to said soundboard for securing end of said strings to said soundboard, said improvement further comprising disposing the opposite ends of said strip proximal to but spaced from the respective curves of said ridge.

12. The improvement of claim 11 wherein points of focus of said curves are substantially at the ends of said string strip.

13. The improvement of claim 12 in which shapes of said curves are selected from ellipses and parabolas.

14. The improvement of claim 13 in which a shape of at least one of said curves is parabolic having a focus point at one of the ends of the string strip that is proximal thereto.

15. The improvement of claim 14 in which said parabolic curve is disposed at one end of said soundboard and a lowest bass string of said strings is secured to one of the ends of the string strip that is proximal to said one end of said soundboard.

16. In a musical instrument of a harp type having a body, a neck having an end connected to an upper end of said body, a post at another end of said neck extending to a lower end of said body, said body comprising a case having a rear side and an open front side and a soundboard closing the front side of said case, said soundboard having a front side facing generally in a direction of said neck and post, and strings connected to and stretched between said neck and said soundboard, the improvement comprising a horizontal strut secured to and extending normal to said post and a plurality of releasable securement means for releasably securing said post to the front side of said soundboard for a substantial lateral extent on opposite sides of said post, said releasable securement means allowing said soundboard to freely vibrate along edges thereof.

17. The improvement of claim 16 in which said strut extends substantially across said soundboard and case.

18. The improvement of claim 16 in which said releasable securement means comprises peg holes formed in said soundboard and pegs at corresponding locations on said strut sized to fit said holes, thereby securing said strut to said soundboard, said pegs being spaced from said post.

19. In a musical instrument of a harp type having a neck at an upper end and a body comprising a case having a plurality of edges defining an open front side, and a soundboard having front and rear sides and having edges adjacent the edges of said case, closing the front side of said case, and strings connected to and stretched between said neck and said soundboard so as to impart a force on said soundboard, and a string strip secured centrally and axially to said soundboard for securing said strings to said soundboard, the improvement comprising a ridge along the edges of said soundboard on a side facing said case extending into said case and formed so as to reflect sound vibrations, said ridge being formed into curves at upper and lower ends of said soundboard to concentrate said reflected vibrations at positions intermediate said upper and lower ends, opposite ends of said string strip being disposed proximal to but spaced from the curves at said upper and lower ends respectively, of said ridge, points of focus of said curves being substantially at the ends of the string strip that are proximal thereto, a shape of at least one of said curves being parabolic.

20. The improvement of claim 19 in which said parabolic curve is disposed at a first of the ends of said soundboard and a lowest bass string of said strings is secured to one of the ends of the string strip that is proximal to said first soundboard end.

* * * * *